US005618118A

United States Patent [19]

Matsumoto et al.

[11] Patent Number: 5,618,118

[45] Date of Patent: Apr. 8, 1997

[54] IMPACT PRINTER AND RIBBON CASSETTE

[75] Inventors: Yoshikane Matsumoto; Toshio Hiki; Shingo Nakahara; Kohichi Yageta; Hiroyuki Kurosawa; Kohki Kushima, all of Hitachinaka, Japan

[73] Assignee: Hitachi Koki Co., Ltd., Tokyo, Japan

[21] Appl. No.: 490,150

[22] Filed: Jun. 14, 1995

[30] Foreign Application Priority Data

Jun. 30, 1994 [JP] Japan ..... 6-149349

[51] Int. Cl.[6] ..... B41J 32/02

[52] U.S. Cl. ..... 400/208; 400/196.1; 400/195

[58] Field of Search ..... 400/194, 195, 400/196, 196.1, 207, 208; 33/623; 271/227, 255

[56] References Cited

U.S. PATENT DOCUMENTS

| | | | |
|---|---|---|---|
| 4,367,963 | 1/1983 | Daughters | 400/208 |
| 4,798,486 | 1/1989 | Kaneko | 400/208 |
| 5,215,391 | 6/1993 | Daley et al. | 400/208 |

*Primary Examiner*—John S. Hilten
*Assistant Examiner*—Daniel J. Colilla
*Attorney, Agent, or Firm*—Whitham, Curtis, Whitham & McGinn

[57] ABSTRACT

A printer and ribbon cassette with gears for transmitting power from the drive motor of the printer to the ribbon cassette. Guides are provided for guiding the ribbon cassette in a direction perpendicular to the rotational axis of the gears, so that the ribbon cassette slides easily into place and the gears engage easily, but the gears are tightly engaged.

4 Claims, 4 Drawing Sheets

IMPACT PRINTER AND RIBBON CASSETTE

BACKGROUND OF THE INVENTION

1. Field of the Invention

The present invention relates to a printer and a ribbon cassette used in the printer.

2. Description of the Related Art

To facilitate mounting and ink ribbon to a printer, there has been known a ribbon cassette, having two ribbon-supporting arms, that can be mounted to the printer by-merely pressing the ribbon cassette in place. The ribbon cassette eliminates the need for a user to touch the ink ribbon directly, so that he or she can replace the ink ribbon without staining his or her hands with ink. The structure and mounting method of the ink ribbon cassette will be described while referring to FIGS. 1 and 2.

The ribbon cassette 110 includes a pair of arms 115, a pair of ribbon drive rollers 112, a ribbon brake 113, and a Mobius portion 14. The arms 115 are provided at either end of the ribbon cassette 110 extending toward the sheet to be printed. The ribbon drive rollers 112 are provided in opposition at one end of the ribbon cassette 110 so as to be rotatable about respective axial shafts 112*b*. An ink ribbon 11 is passed between the ribbon drive rollers. 112 and is driven by the ribbon drive rollers 112 in the direction indicated by an arrow in FIG. 1. The ribbon brake 113, which is for applying tension to the ribbon 11, and the Mobius portion 14, which is for reversing sides of the ribbon 11, are provided at the other end of the ribbon cassette 110.

A ribbon motor 121 and cassette holders 20 are provided on the mounting base 122 of the printer. The cassette holders 20 have a snap-fit portion 20*a* for maintaining the ribbon cassette 110 in place in the-printer. The ribbon motor 121 is for driving the ribbon drive rollers 112. The ribbon cassette 110 is mounted in the printer by engaging the ribbon cassette 110 in the snap-fit portion 20*a*. When the ribbon cassette 110 is mounted in the printer in this way, the rotation shaft of one of the ribbon drive rollers 112 is brought into alignment with the shaft of the ribbon motor 121. The lower tip of that ribbon drive roller 112 engages directly with the output shaft of the ribbon motor 121, thereby allowing transmission of drive power. The engagement between the lower tip of the ribbon drive roller 112 and the output shaft of the ribbon motor 121 is the same as engagement between a tape spool of a tape cassette and a drive shaft of a tape player. Both cases require leeway between engaging components of one millimeter or more, which results in a loose fit between engaging components.

SUMMARY OF THE INVENTION

Because components for transmitting power from the ribbon motor 121 to the ribbon drive rollers 112 are engaged with only a loose fit, the speed at which the ink ribbon is driven is difficult to control as will be described below. This sometimes results in faintly printed or scratchy-looking characters.

The above-described ink ribbon cassette can be used on a high-speed dot line printer. Such a dot line printer includes a reciprocally scanning hammer bank on which are mounted a plurality of dot print hammers that are vertically-aligned to form a printing surface. A mechanism is also provided for step-feeding a print sheet each time the hammer bank reverses direction. Each character is formed from several dot lines printed by reciprocally scanning the hammer bank while feeding the print sheet. Alternatively, characters can be printed in line units, with each scan of the hammer bank printing a line of characters. However, the ink ribbon can drag or stretch slightly, especially directly after the hammer bank reverses direction. This can cause print hammers to hit the same position of the ink ribbon more than once in succession. This results in an insufficient supply of ink for an instant, which produces faint looking characters.

To prevent this problem, the speed of the ribbon motor can be controlled to change the speed of the ink ribbon before and after the hammer bank changes directions. However, this method requires obtaining a desired speed for the ink ribbon at a desired timing, which requires a drive transmission system with good response.

As described above, components of the ribbon cassette 122 and the printer for transmitting power are engaged with a loose fit. This prevents the ink ribbon from changing speed immediately after the ribbon motor switches speed so that the important timing requirement can not be met. That is, as long as a great deal of leeway exists between the components for transmitting power, the speed at which the ink ribbon is fed can not be appropriately controlled so the problem of faintly printed characters Will remain. In addition, the leeway causes excessive noise when the ink ribbon is driven. Also, because the ribbon drive roller is driven by the ribbon motor directly (i.e., without use of reduction gears), a large ribbon motor capable of outputting a large torque is necessary.

Feed movement of the ink ribbon is generally detected by detecting rotation of a roller, or similar element mounted to the printer, rotated with and directly against the ink ribbon. This detection method requires that the ink ribbon be wrapped against the roller. The ribbon sensor having an internal roller must be provided on the printer, and not the ribbon cassette, because attaching the ribbon sensor to the ribbon cassette is difficult and because providing the ribbon sensor to the ribbon cassette would increase costs. Therefore, when the ribbon cassette is mounted to the printer, a portion of the ink ribbon must wind around the roller portion of the ribbon sensor. As described above, the ribbon cassette is conventionally mounted to the printer in the axial direction of the ribbon drive roller. Because the ink ribbon extends perpendicular to the axial direction of the ribbon drive roller, it is impossible to mount the ribbon cassette so that the ribbon wraps around a portion of the ink ribbon sensor roller. Therefore, an operator must wrap the ink ribbon around a portion of the ribbon sensor roller by hand. As a result, the ink ribbon is no longer easy to mount to the printer, which is the main objective of the ribbon cassette.

Also, the cassette holder determines the positioning of the ink ribbon against the printing surface of the hammer bank. Because the ribbon-positioning tip of the arms is separated from the cassette holder by a great distance, the position and posture of the ink ribbon against the printing surface of the hammer bank can vary greatly, adversely effecting the feeding status of the ink ribbon. The variability in position of the ink ribbon can be caused by variation in arm length, loose fit of the ribbon cassette in the cassette mount, expansion and contraction of the arm material when heated or cooled, or any combination of these.

It is an objective of the present invention to provide a printer wherein components for transmitting power from the ribbon motor to the ribbon cassette engage in a tight fit, but wherein the ribbon cassette remains easy to mount to the printer and which allows printing of characters with good quality. It is a further objective of the present invention to provide a printer with a ribbon sensor and with improved precision in positioning of the ink ribbon against the printing surface of the hammer bank.

To achieve these objectives, a printer according to the present invention includes a mounting base to which the ribbon cassette is detachably mountable and a motor provided in the mounting base and having a motor shaft to which a motor gear protruding from the mounting base is attached. A ribbon cassette according to the present invention includes a ribbon cassette housing; an ink ribbon housed in the ribbon cassette housing; a drive roller for transporting the ink ribbon and rotatably disposed about a roller shaft; and a roller gear attached to an end of the roller shaft and engaging with the motor gear when the ribbon cassette is in a mounted condition to the mounting base.

According to another aspect of the present invention, the printer also includes a first position determining means provided adjacent to the motor gear and the ribbon cassette also includes a second position determining means engaging with the first position determining means when the ribbon cassette is in a mounted condition to the mounting base.

According to still another aspect of the present invention, the printer further includes a cassette guide for guiding attachment and detachment of the ribbon cassette provided to the mounting base; and the ribbon cassette further includes a guide member working in association with the cassette guide to guide the ribbon cassette in a direction perpendicular to the motor shaft and into a mounted condition to the mounting base.

Therefore, the present invention uses gears for transmitting power from the drive motor to the ribbon cassette. The ribbon cassette is easily mounted to the printer by sliding it in the direction perpendicular to the rotational axis of the gears. The ribbon cassette slides easily into place and the gears engage easily, but the gear are tightly engaged.

According to a further aspect of the present invention, the roller gear and the motor gear form a gear train that transmits rotation of the motor at a reduced speed to the drive roller. Therefore, a smaller motor with less torque can be used to drive the ink ribbon.

It is preferable that the cassette guide of the printer further includes a latching means for holding the guide member fast when the ribbon cassette is mounted to the mounting base. Preferably at least two latches are provided to the printer: one each to the left and right sides of the ribbon cassette.

It is preferable that the printer further include a ribbon sensor for detecting movement of the ink ribbon and that the ribbon sensor be positioned so that the ink ribbon is brought into contact therewith when the ribbon cassette is guided in a direction perpendicular to the motor shaft. The ribbon sensor is mounted on the printer at a position so that sliding movement of the ribbon cassette wraps the ink ribbon against the ribbon sensor.

It is also preferable that the ribbon cassette further includes arm portions each with a tip and each extending from the ribbon cassette housing, the ink ribbon passing between the tips of the arm portions; and a first ribbon guide being provided to each arm portion. In this case the printer further includes a printing surface with an impact element and a second ribbon guide provided on the mounting base and working in association with the first ribbon guide to guide the tips of the arm portions so that, when the ribbon cassette is mounted to the mounting base, the ink ribbon confronts the impact element of the printing surface.

With this configuration, large variations in positioning of the ink ribbon to the printing surface of the hammer bank are eliminated. The position of the ink ribbon against the printing surface is determined by the ribbon guides and not by the arms of the ribbon cassette. However, so that the ribbon guides effectively guide the ink ribbon, the ribbon cassette is designed so that, when the ribbon cassette is mounted to the printer, the tips of the arms are behind the printing surface, that is, closer to the ribbon cassette than is the printing surface of the hammer bank.

It is desirable that the printer further include marks provided on the mounting-base that are covered by the ribbon cassette when the cassette is correctly mounted to the mounting base, but remains exposed when the ribbon cassette is incorrectly mounted to the mounting base. These marks warn an operator when one of the latches is incompletely engaged.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
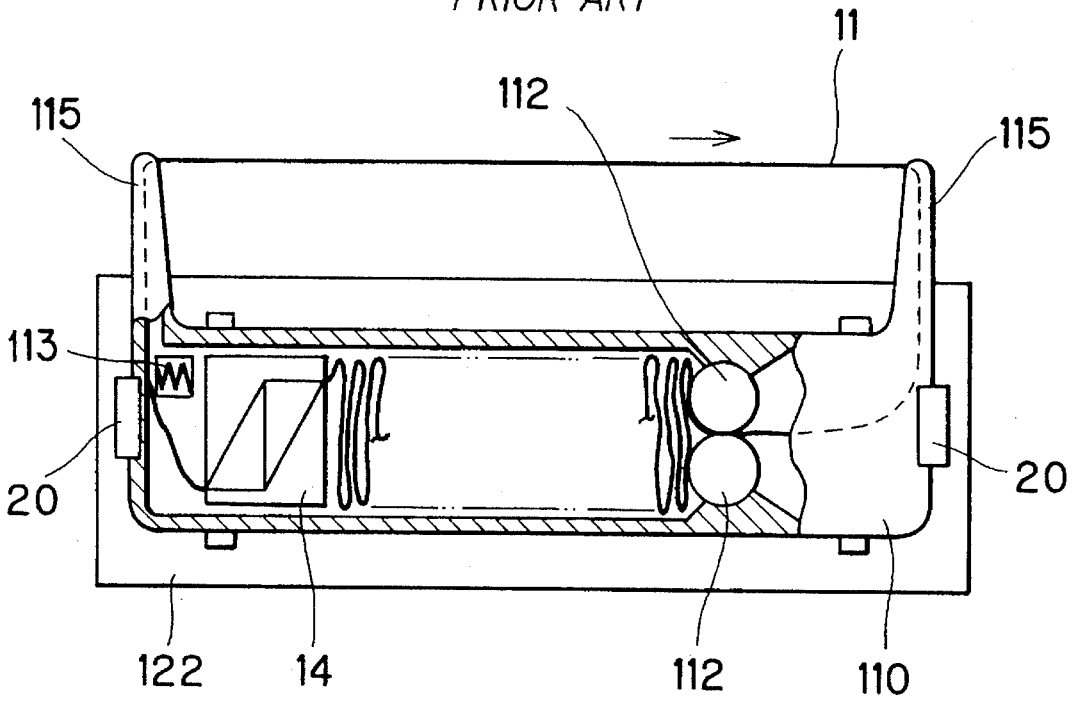
FIG. 1 PRIOR ART
FIG. 1 is a plan view showing a conventional ribbon cassette mounted to a printer, with the interior of the ribbon cassette exposed.
Figure 2:
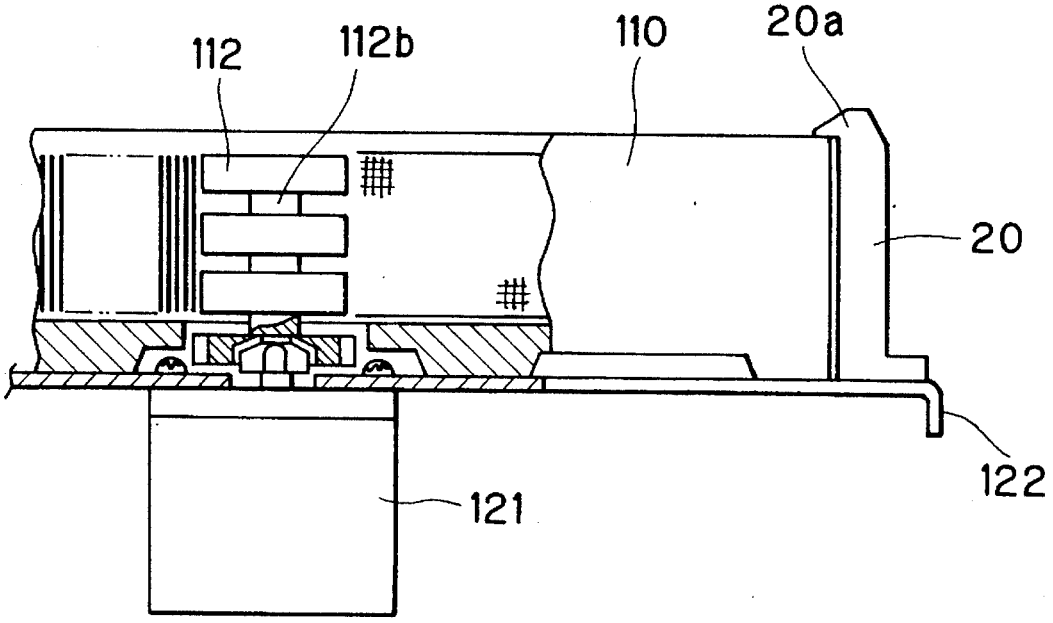
FIG. 2 PRIOR ART
FIG. 2 is a cross-sectional view showing engagement between ribbon drive rollers of the ribbon cassette of FIG. 1 and a motor of the printer of FIG. 1.

A ribbon cassette according to a preferred embodiment of the present invention will be described while referring to the accompanying drawings wherein like parts and components are designated by the same reference numerals to avoid duplicating description.

Figure 3:
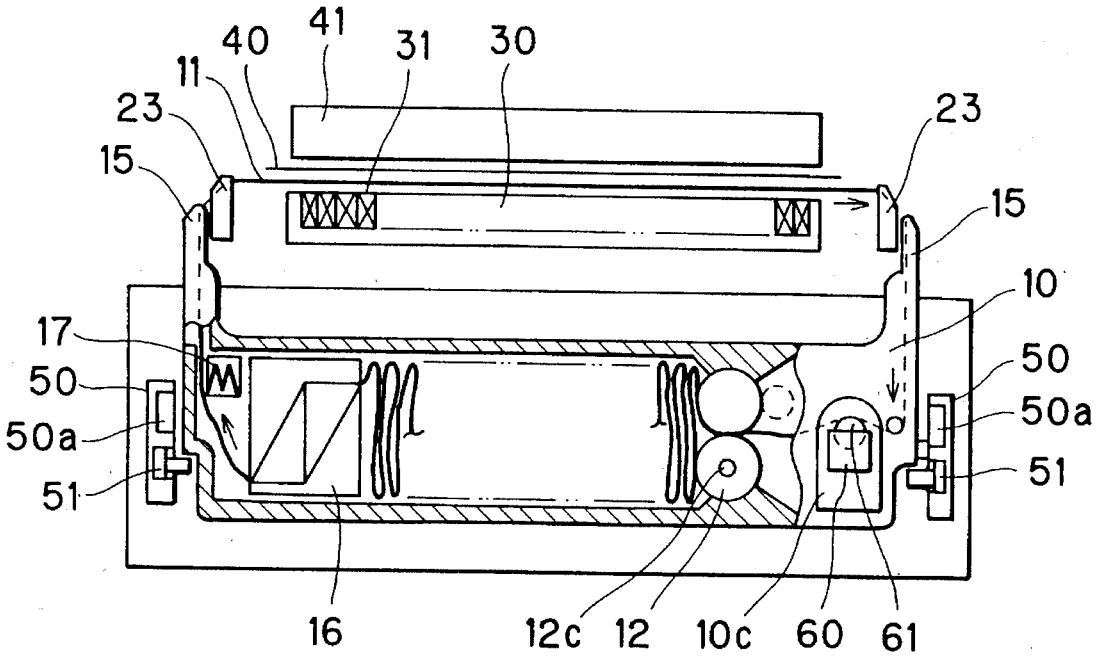
FIG. 3 is a plan view showing a ribbon cassette according to the present invention mounted to a printer according to the present invention, with the interior of the ribbon cassette exposed.

FIG. 3 shows a plan view of the printer print mechanism with the ribbon cassette 10 mounted thereto. The present embodiment describes the present invention applied to a dot line printer, but the present invention can be applied to any type of impact printing device.

A hammer bank 30 is disposed opposing a platen 41 separated therefrom by a predetermined gap. A step-feed motor (not shown) is provided for rotating the platen 41, thereby step-feeding a recording sheet 40 in the vertical direction (i.e., perpendicular to the sheet face on which FIG.

1 is drawn). A plurality of print hammers 31 forming a printing surface for printing dots are aligned horizontally (left to right in the FIG. 3) along the hammer bank 30. A reciprocal transport mechanism (not shown) is provided for reciprocally scanning the hammer bank 30 in the horizontal direction.

A ribbon sensor 60 for detecting the feeding status of the ink ribbon 11 is provided to the printer 1. A rotatable sensor roller 61 having a magnet mounted at its periphery is housed in the ribbon sensor 60. A lead switch, or other means that uses the magnet to detect rotation of the sensor roller 61, is also provided on the ribbon sensor 60. A window 10*c* (also see FIG. 7) for receiving the ribbon sensor 60 is formed in the ribbon cassette 10.

A pair of ribbon drive rollers 12 for driving the ink ribbon 11 in directions indicated by arrows in FIG. 3 are provided adjacent to the ribbon sensor 60. The ink ribbon 11 is an endless ribbon wound in a switchback configuration and housed in the ribbon cassette 10 at an area adjacent to the ribbon drive rollers 12. A ribbon motor 21 (refer also to FIG. 6) is provided on the printer 1 for rotating the ribbon drive rollers 12. A Mobius portion 16 for reversing surfaces of the ink ribbon 11, so that both surfaces of the ink ribbon 11 will be used, is provided adjacent to the area for housing the ink ribbon 11. A brake portion 17 for applying tension to the ink ribbon 11 is disposed in the ribbon cassette 10 adjacent to the Mobius portion 16.

Printing operations will be briefly described. The hammer bank 30 is scanned first in one direction vertically across the surface of the recording sheet 40 while the print hammers 31 strike the recording sheet 40 through the ink ribbon 11. The rotation of the ribbon drive rollers 12 feeds the ink ribbon 11 in synchronization with scanning movement of the hammer bank 30. The brake portion 17 applies a tension to the ink ribbon 11 while the ink ribbon 11 is being fed. Then the hammer bank 130 reverses directions at the edge of the recording sheet 40. While the hammer bank 30 is reversing direction, the platen 41 is rotated by the step-feed motor so that the recording sheet 40 is step fed one line's distance in the vertical direction.

Figure 4:
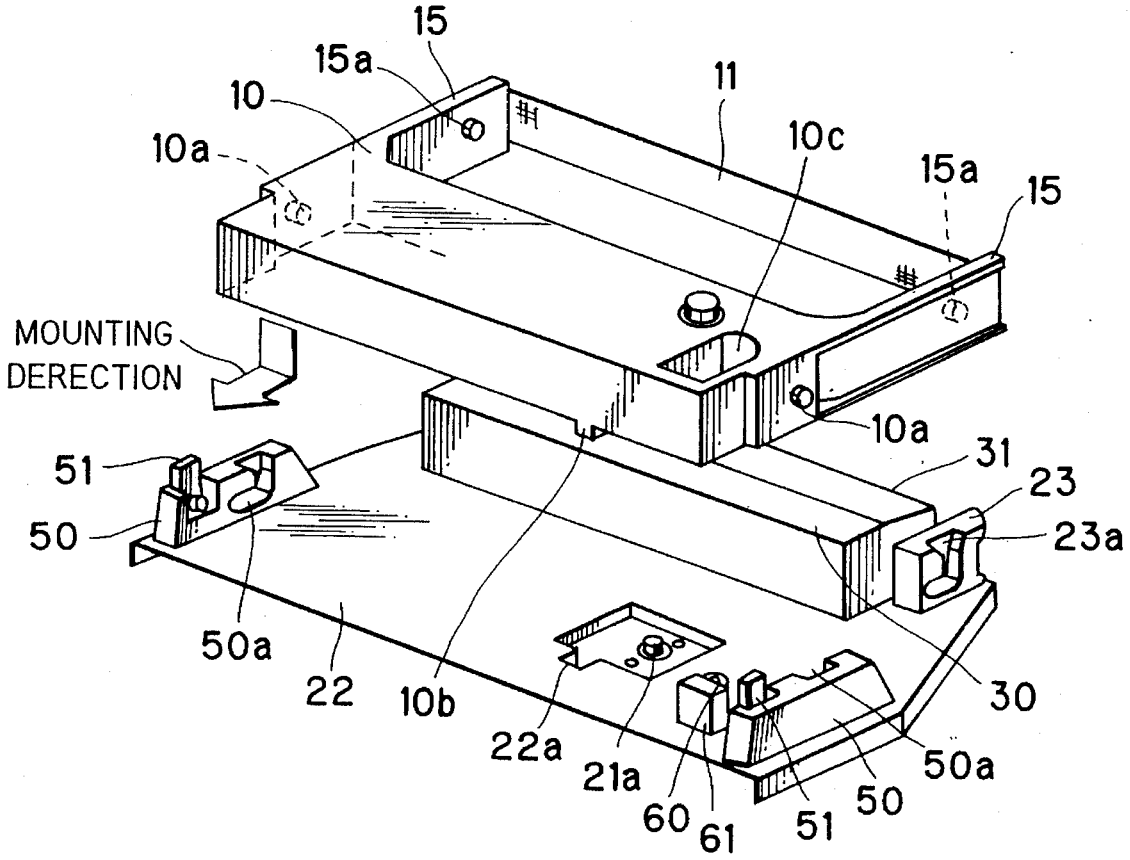
FIG. 4 is a perspective view showing the ribbon cassette of FIG. 3 being mounted to the printer of FIG. 3.

Components relating to mounting the ribbon cassette 10 to the printer 1 will be described in further detail below while referring to FIGS. 3 through 7. As shown in FIG. 4, a pair of mounting bosses 10*a* are provided on the ribbon cassette 10, one at either side of the ribbon cassette 10. A pair of ribbon-positioning bosses 15*a* are provided facing each other, one at the interior of each arm 15. Also a protrusion 10*b* is provided to the base of the ribbon cassette 10. As will be described later, the protrusion 10*b* is for positioning components are for transmitting drive power from the printer 1 to the ribbon cassette 10.

A pair of cassette guides 50, each for receiving one of the mounting bosses 10*a* when mounting the ribbon cassette 10 to the printer 1, are provided on the mounting base 22 of the printer 1 at either side of the mounted ribbon cassette 10. A substantially L-shaped groove 50*a* for receiving a corresponding mounting boss 10*a* is formed in each of the cassette guides 50. A latch lever 51 is pivotally mounted to each of the cassette guides 50 on a shaft 51*c* which acts as an axis on which the corresponding latch lever 51 pivots. Each latch lever 51 includes a push-out protrusion 51*b* and a hook 51*a* with a slanted tip. A spring 52 is connected between the frame of the ribbon cassette 10 and the latch lever 51 so as to urge the latch lever 51 to pivot (counter-clockwise as viewed in FIG. 5).

A pair of ribbon guides 23, each for receiving one of the ribbon-positioning bosses 15*a* when the ribbon cassette 10 is mounted to the printer 1, are provided on the printer 1 at either side of the hammer bank 30. A groove 23*a* for receiving a corresponding ribbon-positioning boss 15*a* is formed in each of the ribbon guides 23. The grooves 23*a* have the same L-shape as the grooves 50*a* of the cassette guides 50. The ribbon guides 23 determine the position of the ink ribbon 11 and guide movement of the ink ribbon 11 along the printing surface of the hammer bank 30.

Figure 6:
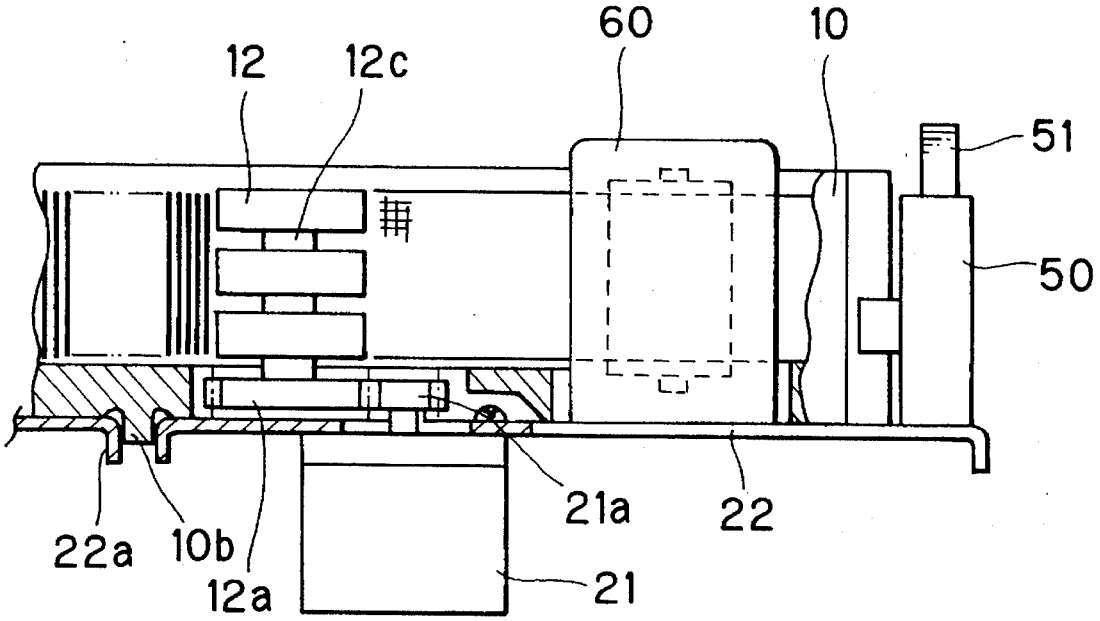
FIG. 6 is a cross-sectional view showing engagement between ribbon drive rollers of the ribbon cassette of FIG. 3 and a motor of the printer of FIG. 3.

A groove 22*a* for receiving the protrusion 10*b* is formed in the mounting base 22 of the printer 1. As shown in FIG. 6, a pinion gear 21*a* is fixed to the output axis of the ribbon motor 21. One of the ribbon drive rollers 12 is located in the ribbon cassette 10 so that, when the ribbon cassette 10 is mounted in the printer, the axial shaft 12*c* is parallel with, but shifted out of alignment with, the output axis of the ribbon motor 21. A gear 12*a* is attached to the axial shaft 12*c* in the ribbon cassette 10. The gear 12*a* and the pinion gear 21*a* are disposed so as to engage in a manner to be described later when the ribbon cassette 10 is mounted to the printer 1.

Figure 7:
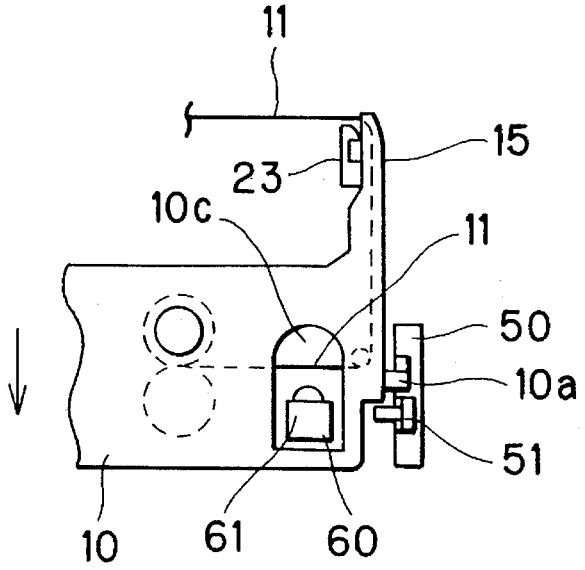
FIG. 7 is a top view schematically showing the relationship of components before the ribbon cassette is slidingly mounted in a direction perpendicular to the axes of rotation of the ribbon drive rollers and the motor of FIG. 6.

The method of mounting the ribbon cassette 10 to the printer 1 will be described. As indicated by the arrow in FIG. 4, the ribbon cassette 10 is first moved toward the mounting base 22 in a direction parallel to the axial shaft 12*c* and to the shaft of the ribbon motor 21 until the ribbon-positioning bosses 15*a* engage in corresponding grooves 23*a* and the mounting bosses 10*a* engage in corresponding grooves 50*a*. At this point, the protrusion 10*b* is horizontally adjacent to the groove 22*a* and the gear 12*a* is horizontally aligned with the pinion gear 21*a*. Also, as shown in FIG. 7, the tip of each arm 15 protrudes ahead of corresponding 10 ribbon guides 23 and the ribbon sensor 60 is engaged in the window 10*c* so that the sensor roller 61 is adjacent to, but does not contact, the ink ribbon 11.

As the bosses 15*a* and 10*a* follow the L-shapes of corresponding grooves 23*a* and 50*a*, movement of the ribbon cassette 10 becomes perpendicular to the axial shaft 12*c* and to the shaft of the ribbon motor 21. As the ribbon cassette 10 proceeds in this perpendicular direction, the protrusion 10*b* and the gear 12*a* slide into engagement with the groove 22*a* and the pinion gear 21*a* respectively. Also, the mounting bosses 10*a* abut the slanting surface of corresponding hooks 51*a*, forcing the latch levers 51 to pivot clockwise against the urging force of corresponding springs 52.

When the mounting bosses 10*a* proceed beyond the tips of corresponding hooks 51*a*, the latch levers 51 snap back in the counter-clockwise direction, latching corresponding mounting bosses 10*a* in place with hooks 51*a*. At this point, the gear 12*a* is engaged tightly with the pinion gear 21*a* (that is, with a gear backlash of only 0.1 mm). Because the gears for transmitting power from the ribbon drive roller and the ribbon motor are tightly engaged, the speed of the ink ribbon can be accurately switched at the desired timing. Therefore, faintly printed characters can be prevented.

Also at this point, the ribbon-positioning bosses 15*a* are positioned at the inward base of corresponding grooves 23*a* so that, as shown in FIG. 3, the tip of each arm 15 is slightly retracted behind its corresponding ribbon guide 23 and the sensor roller 61 is in abutment with the ink ribbon 11. Engagement between the ribbon-positioning bosses 15*a* and the grooves 23*a* of ribbon guides 23 accurately positions the arms 15. Also, the ink ribbon 11 itself is accurately positioned against the printing surface of the hammer bank 30 by the ribbon guides 23 to the left and right of the ribbon cassette 10. The feed position of the ink ribbon 11 against the printing surface of the hammer bank 30 is determined by ribbon guides 23 of the printer and arms 15. Because the tips of the arms 15 are retracted behind the ribbon guides 23, and are closer to the ribbon guides 23 than to the printing surface, the ink ribbon is fed with greater stability.

Because power from the ribbon motor 21 is transmitted to the ribbon drive roller 12 by the large gear 12*a* and the smaller pinion gear 21*a*, the ribbon motor 21 needs only a small torque to drive the ribbon drive rollers 12, so that a small and inexpensive motor can suffice as the ribbon motor 21. The ribbon drive roller 12 and an opposing roller 13 rotate in unison. As shown in FIGS. 3 and 7, the opposing roller 13 includes an opposing roller gear 13*a* which is driven by the large gear 12*a* to make the rollers rotate in unison.

Because the sensor roller 61 is sufficiently separated from the printer 1 when the ribbon sensor 60 is first engaged with the window 10*c*, the ink ribbon 11 will not snag against or interfere with the ribbon sensor 60. Later, when the L-shaped grooves 23*a* and 50*a* cause the ribbon cassette 10 to move in the direction perpendicular to the shaft 12*c* and the shaft of the motor 21, the sensor roller 61 is pressed against the ink ribbon 11 with sufficient force so that the ink ribbon 11 wraps around the sensor roller 61 and rotates the sensor roller 61 when driven by the ribbon drive rollers 12. The ribbon sensor 60 can then accurately detect movement of the ink ribbon 11. With this configuration, the ink ribbon will not snag on the ribbon sensor during mounting of the ribbon cassette and the ink ribbon cassette can be easily mounted.

Figure 5:
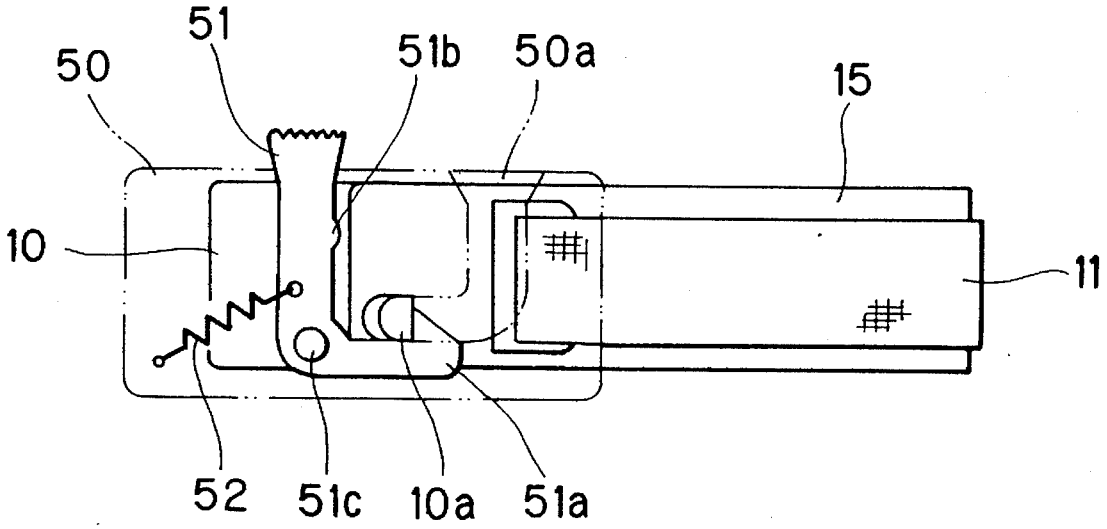
FIG. 5 is a cross-sectional view showing components of the ribbon cassette and the printer of FIG. 3 related to latching the ribbon cassette to the printer.

Removal of the ribbon cassette 10 from the printer 1 will be described while referring to FIG. 5. An operator pulls the grips of the latchlevers 51 (leftward as viewed in FIG. 5) so that the latch levers 51 pivot (clockwise as viewed in FIG. 5). This simultaneously releases the hooks 51*a* from corresponding mounting bosses 10*a* and presses the push-out protrusions 51*b* against the ribbon cassette 10. Because the hooks 51*a* are unlatched from the mounting bosses 10*a*, the ribbon cassette 10 is free to follow the urging force of the push-out protrusions 51*b*. The mounting bosses 10*a* follow the grooves 51*a* leftward with the movement of the ribbon cassette 10. When mounting bosses 10*a* reach the bend in corresponding grooves 51*a*, the operator can then pull the ribbon cassette 10 upward and out of the printer 1.

Conventionally, two steps are required to remove a slidingly mounted ribbon cassette from the printer: the ribbon cassette is first unlatched from the cassette holders and then slid out of the cassette holders. The inventive latch levers 51 allow removing the ribbon cassette 10 from the printer in a single step. This simplifies operations for detaching the ribbon cassette 10 from the printer. In this way, the ribbon cassette 10 is easily removed from the printer by operating the latch levers 51 once to both unlatch the mounting bosses 10*a* and to move the ribbon cassette 10 back its initial position of before being guided in the direction perpendicular to the shaft of the motor 21.

Figure 8:
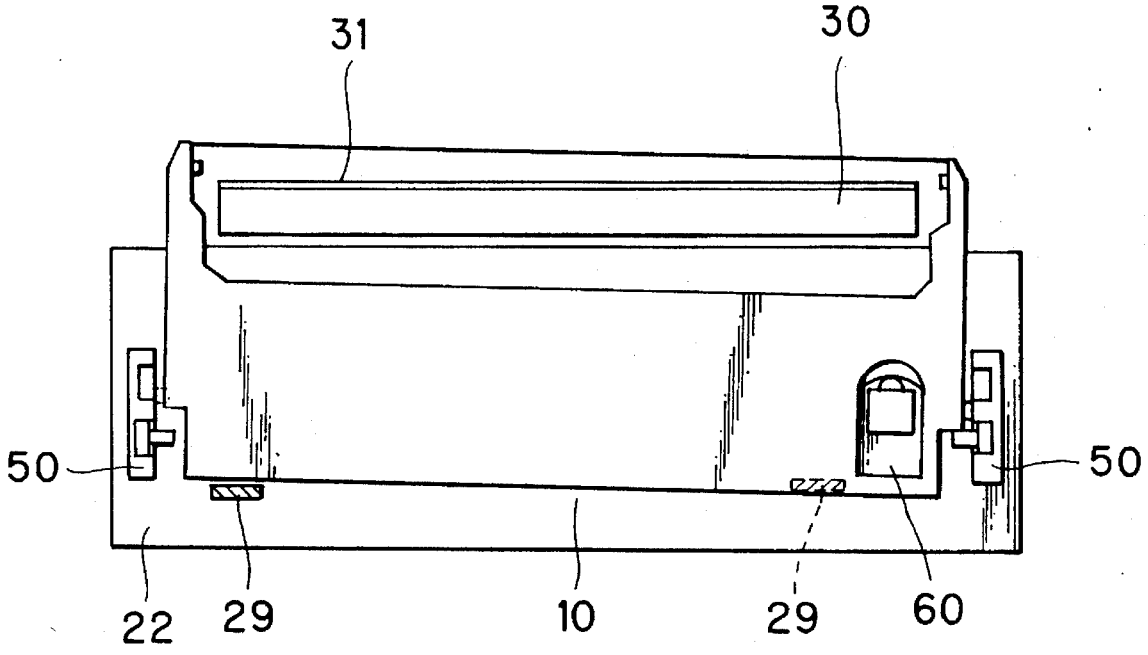
FIG. 8 is a top view showing marks for indicating when the ribbon cassette is incorrectly mounted to the printer.

When the hooks 51*a* of the latch levers 51 do not correctly hook onto the mounting bosses 10*a*, the ribbon cassette 10 will be incorrectly mounted to the printer 1 as shown in FIG. 8. When the ribbon cassette 10 is incompletely mounted to the printer 1, the ribbon cassette 10 is postured at an angle in relationship to the hammer bank 30. This results in the gear 12*a* and the pinion gear 21*a* either engaging poorly or not at all. Transmission of power is not possible, or unstable at best, so that any printing that is accomplished is of poor quality.

To allow an operator to visually confirm that the ribbon cassette 10 is correctly mounted to the printer 1, marks 29 are provided at predetermined locations on the mounting base 22. As shown in FIG. 8, when the ribbon cassette 10 is incorrectly mounted, one of the marks 29 will be exposed. If the ribbon cassette 10 is correctly mounted, the marks 29 will not be visible. The marks 29 could simply be made from bands colored red or in some other conspicuous color, or could be a message warning the operator that the ribbon cassette 10 is incorrectly mounted. The marks 29 allow an operator to accurately determine the positioning of the mounted ribbon cassette 10. Therefore, the operator can easily determine whether the latch levers 51 correctly engaged with corresponding mounting bosses 10*a*. This helps prevent potential problems caused when the printer is used when the ribbon cassette is incorrectly mounted in the printer.

While the invention has been described in detail with reference to a specific embodiment thereof, it would be apparent to those skilled the art that various changes and modifications may be made therein without departing from the spirit of the invention, the scope of which is defined by the attached claims.

For example, the configuration of the protrusion 10*b* and the groove 22*a* could be reversed, with the protrusion 10*b* provided to the printer 1 and the groove 22*a* provided to the printer 1. Regardless, these components need to be provided near the ribbon drive rollers 12 to ensure precise and tight engagement between gears of the ribbon drive rollers 12 and the ribbon motor 21.

Also, the configuration of the ribbon-positioning bosses 15*a* and the grooves 23*a* could be reversed, with the ribbon-positioning bosses 15*a* provided to the printer 1 and the grooves 23*a* provided to the printer 1.

What is claimed is:

1. A printer and a ribbon cassette, the printer comprising:

a mourning base for detachably mourning the ribbon cassette; and a motor located in the mounting base having a motor shaft and a motor gear attached to said motor shaft protruding from the mounting base;

the ribbon cassette comprising:

a ribbon cassette housing;

an ink ribbon housed in the ribbon cassette housing;

a roller shaft located within said ribbon cassette housing;

a drive roller for transporting the ink ribbon rotatably disposed about said roller shaft; and a roller gear attached to an end of the roller shaft for engaging the motor gear when the ribbon cassette is mounted on the mounting base, the printer further comprising first position-determining means adjacent to the motor gear for determining a position of said ribbon cassette, and the ribbon cassette further comprising second position-determining means for engaging the first position-determining means when the ribbon cassette is mounted on the mounting base, the printer further comprising a cassette guide for guiding attachment and detachment of the ribbon cassette located on the mounting base; and the ribbon cassette further comprising a guide member, working in association with the cassette guide, for guiding the ribbon cassette in a direction perpendicular to the motor shaft for mounting the ribbon cassette on the mounting base, wherein the printer further comprises a ribbon sensor for detecting movement of the ink ribbon and positioned so that the ink ribbon is brought into contact with said ribbon sensor when the ribbon cassette is guided in said direction perpendicular to the motor shaft.

2. A printer and a ribbon cassette the printer comprising:

a mounting base for detachably mounting the ribbon cassette; and a motor located in the mounting base having a motor shaft and a motor gear attached to said motor shaft protruding from the mounting base;

the ribbon cassette comprising:

a ribbon cassette housing;

an ink ribbon housed in the ribbon cassette housing;

a roller shaft located within said ribbon cassette housing;

a drive roller for transporting the ink ribbon rotatably disposed about said roller shaft; and a roller gear attached to an end of the roller shaft for engaging the motor gear when the ribbon cassette is mounted on the mounting base, the printer further comprising a cassette guide for guiding attachment and detachment of the ribbon cassette located on the mounting base; and the ribbon cassette further comprising a guide member, working in association with the cassette guide, for guiding the ribbon cassette in a direction perpendicular to the motor shaft for mounting said ribbon cassette on the mounting base, wherein the printer further comprises a ribbon sensor for detecting movement of the ink ribbon and positioned so that the ink ribbon is brought into contact with said ribbon sensor when the ribbon cassette is guided in said direction perpendicular to the motor shaft.

3. A ribbon cassette assembly comprising:

a mounting base connectable to a printer;

a motor located in the mounting base having a motor shaft and a motor gear connected to said motor shaft protruding from the mounting base;

a ribbon cassette housing detachably mountable to the mounting base;

an ink ribbon housed in the ribbon cassette housing;

a roller shaft located within said ribbon cassette housing;

a drive roller for transporting the ink ribbon rotatably disposed about said roller shaft;

a roller gear attached to an end of the roller shaft for engaging with the motor gear when the ribbon cassette is mounted on the mounting base;

first position-determining means connected to the mounting base adjacent to the motor gear;

second position-determining means connected to the ribbon cassette for engaging with the first position-determining means when the ribbon cassette is mounted on the mounting base;

a cassette guide connected to the mounting base for guiding said ribbon cassette housing during attachment and detachment of the ribbon cassette housing to and from the mounting base;

a guide member connected to the ribbon cassette housing working in association with the cassette guide for guiding the ribbon cassette housing in a direction perpendicular to the motor shaft for mounting said ribbon cassette on the mounting base; and a ribbon sensor for detecting movement of the ink ribbon and positioned on the mounting base so that the ink ribbon is brought into contact with said ribbon sensor when the ribbon cassette is guided in said direction perpendicular to the motor shaft.

4. A printer and a ribbon cassette, said ribbon cassette comprising:

a ribbon cassette housing; and an ink ribbon housed in said ribbon cassette housing, and said printer comprising:

a mounting base for detachably mounting said ribbon cassette; and a cassette guide located on said mounting base for guiding attachment of said ribbon cassette, wherein said ribbon cassette further comprises a guide member for guiding said ribbon cassette in a direction parallel to said mounting base for mounting said ribbon cassette on said mounting base, and wherein said printer further comprises a ribbon sensor for detecting movement of said ink ribbon and positioned so that said ink ribbon is brought into contact with said ribbon sensor when said ribbon cassette is guided in said direction parallel to said mounting base.

* * * * *